US011819854B2

(12) United States Patent
Kojima et al.

(10) Patent No.: US 11,819,854 B2
(45) Date of Patent: Nov. 21, 2023

(54) HOLDER FOR PLACING ANALYSIS PLATES, AND ANALYSIS KIT

(71) Applicant: ENPLAS CORPORATION, Kawaguchi (JP)

(72) Inventors: Nobuhiro Kojima, Saitama (JP); Yasuhiro Watanabe, Saitama (JP); Koji Muraki, Saitama (JP); Tomoki Nakao, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 564 days.

(21) Appl. No.: 16/758,334

(22) PCT Filed: Nov. 26, 2018

(86) PCT No.: PCT/JP2018/043420
§ 371 (c)(1),
(2) Date: Apr. 22, 2020

(87) PCT Pub. No.: WO2019/116873
PCT Pub. Date: Jun. 20, 2019

(65) Prior Publication Data

US 2020/0316608 A1 Oct. 8, 2020

(30) Foreign Application Priority Data

Dec. 12, 2017 (JP) ..... 2017-238045

(51) Int. Cl.
*B01L 3/00* (2006.01)
*B01L 9/00* (2006.01)

(52) U.S. Cl.
CPC ..... *B01L 9/523* (2013.01); *B01L 3/50855* (2013.01); *B01L 2300/0829* (2013.01)

(58) Field of Classification Search
CPC ..... B01L 9/52; B01L 9/523; B01L 3/50855
(Continued)

(56) References Cited

U.S. PATENT DOCUMENTS 4,319,841 A * 3/1982 Suovaniemi ..... G01N 21/03 356/244
9,782,777 B2 10/2017 Mortillaro et al.
(Continued)

FOREIGN PATENT DOCUMENTS

JP 2009-507238 2/2009
WO 2007/028861 3/2007

OTHER PUBLICATIONS

International Search Report issued in International Application No. PCT/JP2018/043420, dated Feb. 19, 2019, 4 pages.
(Continued)

*Primary Examiner* — Natalia Levkovich
(74) *Attorney, Agent, or Firm* — Hamre, Schumann, Mueller & Larson, P.C.

(57) ABSTRACT

A placement holder 1 for an analysis according to the present invention includes a frame portion 10 for placing an analysis plate, and a coupling portion 11; wherein the analysis plate includes, respectively at opposite ends in a longitudinal direction thereof, protrusions protruding in the longitudinal direction; the frame portion 10 includes a pair of wall portions that are opposed to each other, and a space surrounded by the frame portion 10 has an area 12 in which the analysis plate is to be placed; the pair of wall portions have a pair of cavities 13 into which the protrusions of the analysis plate are to be inserted, and at least one of the pair of cavities 13 is a through hole; the wall portion having the through hole has, on an inner surface thereof, an inclined surface 14 formed such that an interval between inner surfaces of the pair of wall portions gradually decreases from an upper end side toward the through hole of the wall portion; and the coupling portion 11 is disposed below the pair of cavities 13 so as to couple one of the wall portions to the other wall portion.

7 Claims, 7 Drawing Sheets

(58) Field of Classification Search
USPC ..... 422/563, 560
See application file for complete search history.

(56) References Cited

U.S. PATENT DOCUMENTS

| | | | |
|---|---|---|---|
| 2008/0220481 | A1 | 9/2008 | Mortillaro et al. |
| 2015/0205089 | A1 | 7/2015 | Machida et al. |
| 2016/0054340 | A1 | 2/2016 | Gisler et al. |

OTHER PUBLICATIONS

Extended European Search Report issued in corresponding European Patent Application No. 18888752.5, dated Aug. 13, 2021, 8 pages.

* cited by examiner

HOLDER FOR PLACING ANALYSIS PLATES, AND ANALYSIS KIT

TECHNICAL FIELD

The present invention relates to a placement holder for an analysis plate, and an analysis kit.

BACKGROUND ART

Analysis plates are widely used in various analysis methods such as PCR and ELISA. Specifically, for example, a sample is applied to the analysis plate, and the analysis plate is placed in an analysis device in which reactions and detections are conducted.

Ordinarily, in terms of handleability and the like, an analysis plate is placed in a holder. In particular, when conducting reactions for multiple items for one sample, conducting reactions for the same item for a plurality of samples, or conducting reactions for controls, together with reactions for samples, it is important to conduct the reactions simultaneously and under the same conditions. In this case, a plurality of analysis plates are used, and simultaneous reactions and detections under the same conditions can be easily conducted by forming an assembly of the plurality of analysis plates placed in one holder, and using the assembly in the analysis device.

As the method for placing the analysis plate in the holder, for example, the following method has been reported (Patent Document 1). That is, a side wall of a holder is provided with a slot portion, and an analysis plate is provided with a hook-shaped fixing portion, and the analysis plate is fixed to the holder by hooking the hook-shaped fixing portion of the analysis plate to the slot portion of the holder.

CITATION LIST

Patent Document

Patent Document: 1 JP 2009-507238B

SUMMARY OF INVENTION

Technical Problem

However, placement of the analysis plate into the holder has, for example, the problem in that the analysis plate can be easily inserted but is likely to come loose, or the analysis plate is unlikely to come loose but is difficult to insert. In the former case, the analysis plate may come loose, for example, when subjected to vibration or when pressed during a process, and samples thus may be contaminated. In the latter case, due to the difficulty of insertion, an excessive force may be applied to the analysis plate, resulting in deformation of the analysis plate.

Therefore, it is an object of the present invention to provide a placement holder for an analysis plate that allows easy placement of the analysis plate, and from which the placed analysis plate is unlikely to come loose.

Solution to Problem

In order to achieve the above-described object, a placement holder for an analysis plate according to the present invention includes:

a frame portion for placing an analysis plate, and a coupling portion;

wherein the analysis plate includes, respectively at opposite ends in a longitudinal direction thereof, protrusions protruding in the longitudinal direction;

the frame portion includes a pair of wall portions that are opposed to each other, and a space surrounded by the frame portion has an area in which the analysis plate is to be placed;

the pair of wall portions have a pair of cavities into which the protrusions of the analysis plate are to be inserted, and at least one of the pair of cavities is a through hole;

the wall portion having the through hole has, on an inner surface thereof, an inclined surface formed such that an interval between inner surfaces of the pair of wall portions gradually decreases from an upper end side toward the through hole of the wall portion; and the coupling portion is disposed below the pair of cavities so as to couple one of the wall portions to the other wall portion.

An analysis kit according to the present invention includes:

the placement holder according to the present invention; and an analysis plate, wherein the analysis plate includes, respectively at opposite ends in a longitudinal direction thereof, protrusions protruding in the longitudinal direction.

Advantageous Effects of Invention

The placement holder according to the present invention allows easy placement of an analysis plate, and can prevent the placed analysis plate from coming loose due to vibration or the like. Accordingly, it is possible to provide an analysis kit with excellent handleability during analysis or the like.

DESCRIPTION OF EMBODIMENTS

For example, in the placement holder according to the present invention, the space surrounded by the frame portion has a plurality of areas in each of which the analysis plate is to be placed, and the pair of wall portions include the pair of cavities for each position corresponding to one of the plurality of areas.

For example, the placement holder according to the present invention includes: a plurality of the coupling portions, wherein each of the plurality of coupling portions is disposed at a boundary between the plurality of areas.

For example, in the placement holder according to the present invention, the wall portion having the through hole includes, on an inner surface thereof, a first surface and a second surface in that order from an upper end side toward the through hole of the wall portion, the first surface is the inclined surface, and the second surface is located on the through hole side relative to the inclined surface, and constitutes a surface where an interval between inner surfaces of the pair of wall portions is constant, or a surface where the interval between the inner surfaces of the pair of wall portions gradually decreases at a degree smaller than the degree at which the interval between the inner surfaces of the pair of wall portions gradually decreases on the inclined surface.

For example, in the placement holder according to the present invention, each of the pair of wall portions includes, below the corresponding cavity on an inner surface thereof, a protrusion protruding in a direction in which the pair of wall portions are opposed each other, and each of the protrusions is a base portion on which the analysis plate is to be placed.

For example, in the placement holder according to the present invention, a planar shape of the space surrounded by the frame portion is a quadrangular shape.

For example, the placement holder of the present invention is made of resin.

Placement Holder

Embodiments of the placement holder according to the present invention will be described with reference to the drawings. It should be appreciated that the following embodiments are merely illustrative, and the present invention is by no means limited to these embodiments.

Figure 1:
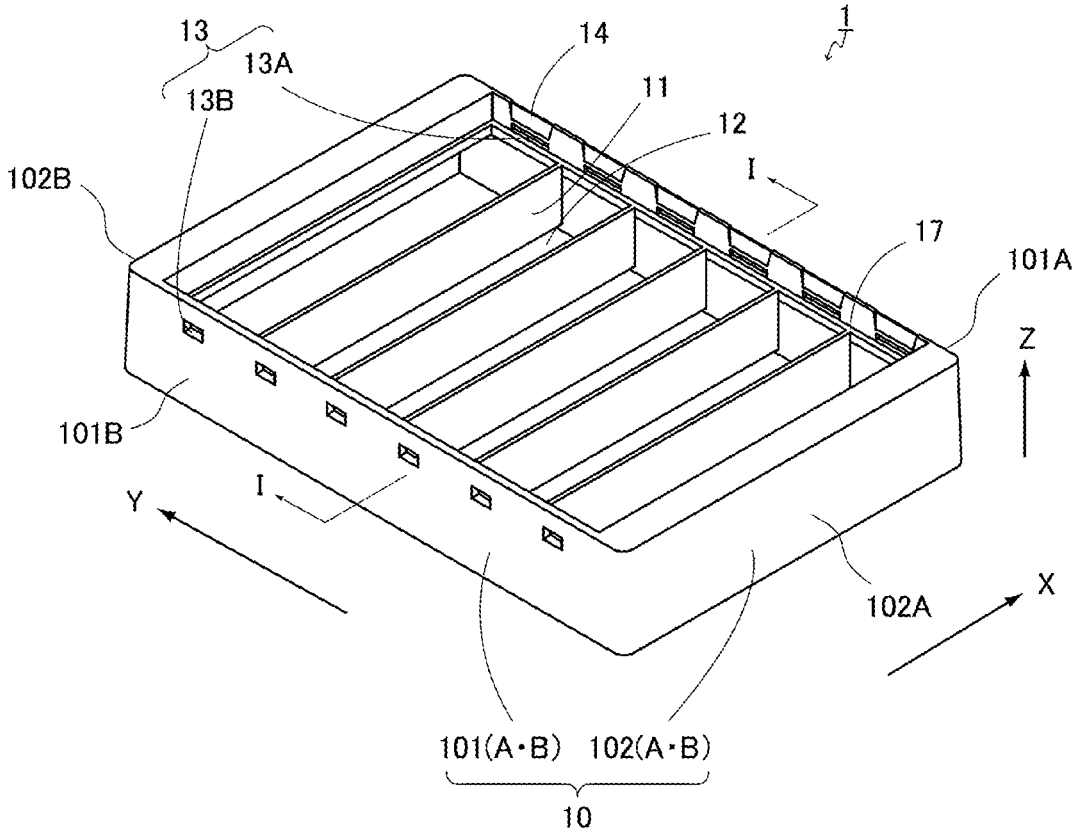
FIG. 1 is a perspective view showing an example of a holder according to the present invention.
Figure 2:
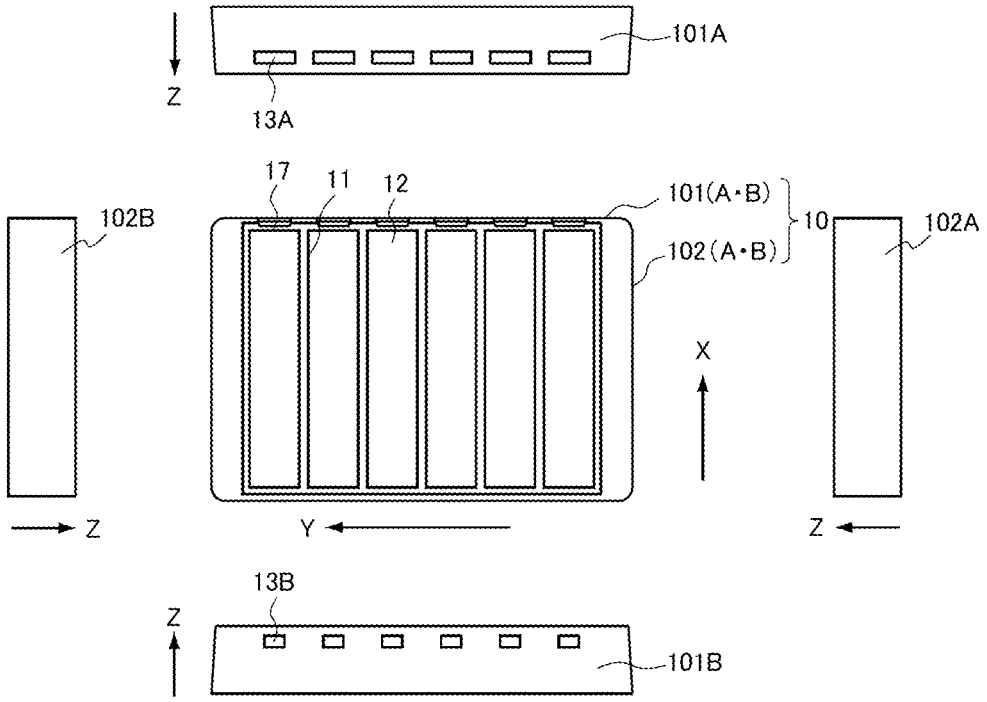
FIG. 2 shows plan views of the holder according to the present invention, with the central diagram showing a plan view as viewed from above, the upper and lower diagrams respectively showing plan views of a pair of first wall portions as viewed from the outside, and the left and right diagrams respectively showing plan views of a pair of second wall portions as viewed from the outside.
Figure 3:
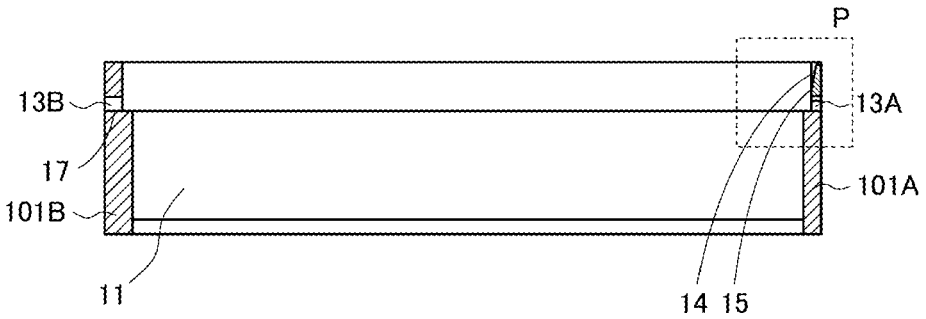
FIG. 3 is a cross-sectional view of the holder according to the present invention, as viewed in the direction of I-I in FIG. 1.

An example of a holder according to the present embodiment is shown in FIGS. 1 to 3. The present embodiment is an example of a placement holder in which a plurality of analysis plates are to be placed. Note that the present invention is not limited thereto, and there is no limitation on the number of analysis plates to be placed, as will be described later.

In the holder of the present embodiment, the frame portion includes two pairs of opposing wall portions, and one pair of wall portions and the other pair of wall portions are coupled to each other to form a frame body. Hereinafter, the pair of wall portions having through holes are referred to as "first wall portions", the direction in which the first wall portions are opposed to each other is referred to as a "first opposing direction", the other pair of wall portions are referred to as "second wall portions", and a direction in which the second wall portions are opposed to each other is referred to as a "second opposing direction".

In the drawings, the same portions are denoted by the same reference numerals. The arrow X indicates the first opposing direction, the arrow Y indicates the second opposing direction, which is perpendicular to the first direction, and the arrow Z indicates a height direction that is perpendicular to the first opposing direction and the second opposing direction. Each of the arrow heads of the arrows shows the same direction in FIGS. 1 and 2.

FIG. 1 is a perspective view of a holder 1 according to the present embodiment. FIG. 2 shows plan views of the holder 1, with the central diagram showing a plan view as viewed from above, the upper and lower diagrams respectively showing plan views of a pair of first wall portions 101 as viewed from the outside, and the left and right diagrams respectively showing plan views of a pair of second wall portions 102 as viewed from the outside. FIG. 3 is a cross-sectional view of the holder 1 as viewed in the direction of I-I in FIG. 1.

The holder 1 includes a frame portion 10 serving as a holder body. The frame portion 10 includes a pair of first wall portions 101 (101A, 101B) that are opposed to each other, and a pair of second wall portions 102 (102A, 102B) that are opposed to each other. The first opposing direction X in which the first wall portions 101 are opposed to each other and the second opposing direction Y in which the second wall portions 102 are opposed to each other are orthogonal to each other, and the pair of first wall portions 101 and the pair of second wall portions 102 are coupled to each other.

The shape of the frame portion 10 is not particularly limited, and may be a quadrangular frame shape, for example. The planar shape (inner shape) of the space surrounded by the frame portion 10 is, for example, a quadrangular shape, as shown in FIGS. 1 and 2. The quadrangular shape may be, for example, a square shape or a rectangular shape. The outer shape of the frame portion 10 is not particularly limited, and may be set as appropriate according to, for example, the shape of an analyzer used for analysis. The outer shape of the holder 1 may be, for example, a quadrangular shape, and may be a square shape or a rectangular shape.

In order to place the analysis plate, the space surrounded by the frame portion of the holder 1 according to the present invention has an area in which the analysis plate is to be placed. Here, an "area" means a placement area for one analysis plate. The space surrounded by the frame portion has one, or two or more areas, for example, according to the number of the analysis plates to be placed. When the space surrounded by the frame portion has a plurality of areas, for example, a partition may or may not be provided between the areas. As will be described later, for example, a coupling portion may act as a partition. The frame portion 10 of the holder 1 shown in FIG. 1 has a plurality of areas 12 extending parallel to the opposing direction X of the first wall portions 101. The number of areas 12 of the holder 1 is not particularly limited. The lower limit is, for example, one or more, and the upper limit is, for example, 12 or less. In FIG. 1, the holder 1 has six areas 12 inside the frame portion 10. However, this is merely illustrative, and the present invention is not limited thereto.

As described previously, in use, an analysis plate is placed in each area of a plurality of areas 12 of the frame portion 10. Thus, the first wall portions 101 (101A, 101B) of the frame portion 10 include, for each of the positions corresponding to the plurality of areas 12, a pair of cavities 13 (13A, 13B) into which protrusions of the analysis plate are to be inserted. There is no particular limitation with respect to the analysis plate placed in the holder 1 when the holder 1 is used, as long as the analysis plate includes, respectively at opposite ends in a longitudinal direction of the analysis plate, protrusions protruding in the longitudinal direction. Regarding the analysis plate, each of the protrusions at the opposite ends serves as an insertion portion to be inserted into the corresponding cavity 13 of the frame portion 10.

The shape of the cavity 13 is not particularly limited, and may be set as appropriate, for example, according to the shape of the protrusions of the analysis plate. The shape of the cavity 13 is, for example, a polygonal shape such as a quadrangular shape, and corner portions thereof may be, for example, sharply angled or curved. Alternatively, the quadrangular shape may be, for example, a square shape, a rectangular shape, a diamond shape, or a trapezoidal shape. In the case of a trapezoidal shape, the trapezoidal shape may expand downwardly, or expand upwardly. Although each of the pair of cavities 13 is shown as a through hole in FIGS. 1 to 3, the present invention is not limited thereto. That is, at least one of the pair of cavities 13 may be a through hole, and the other cavity may be, for example, a through hole or a non-through hole. The cavities (e.g., 13A and 13B) constituting the pair of cavities 13 may have the same shape or different shapes from each other, or may have the same size or different sizes from each other. When a plurality of pairs of cavities are provided, each of the pairs may have the same shape or different shapes, or may have the same size or different sizes from each other. Specifically, in the case of FIG. 2, the cavities 13A provided in the first wall portion 101A have the same shape and size, but they may have different shapes and different sizes from each other, and the cavities 13B provided in the second wall portion 101B have the same shape and size, but they may have different shapes and different sizes from each other.

As described previously, the pair of first wall portions 101 (101A, 101B) of the frame portion 10 include, for each of the positions corresponding to the plurality of areas 12, a pair of cavities 13 (13A, 13B). In the present embodiment, the cavity 13A on the first wall portion 101A side is a through hole, and the cavity 13B on the first wall portion 101B side is also a through hole. However, as described previously, the latter cavity 13B may be either a through hole or a non-through hole. Also, of the first wall portions 101, one wall portion 101A having the cavity 13A that is a through hole, has, on the inner surface thereof, an inclined surface 14 above the cavity (through hole) 13A. As shown in FIG. 3, the inclined surface 14 is formed such that, on an inner surface of the first wall portion 101, the interval between the inner surfaces of the pair of wall portions 101A and 101B gradually decreases from the upper end side of the wall portion 101A toward the cavity (through hole) 13A. That is, it can also be said, for example, that the inclined surface 14 is inclined toward the outer surface, from the cavity (through hole) 13A side toward the upper side. It can also be said, for example, that, above the cavity (through hole) 13A, the thickness of the wall portion 101A gradually decreases toward the upper end of the wall portion 101A. Although FIGS. 1 to 3 show a configuration in which the frame portion 10 has the inclined surface 14 above the cavity (through hole) 13A of the first wall portion 101A, the present invention is not limited thereto. For example, the frame portion 10 may have the inclined surface 14 above the cavity (through hole) 13B of the first wall portion 101B. When each of the cavities 13A and 13B is a through hole, the frame portion 10 may have inclined surfaces 14 above both of the cavities 13A and 13B. Hereinafter, the cavities 13 (13A, 13B) may also be called "through holes 13" (13A, 13B).

When placing the analysis plate in the holder 1, for example, the analysis plate is pressed downward after inserting the protrusion located at one end of the analysis plate into one through hole 13B, whereby the protrusion located at the other end of the analysis plate can be inserted into the other through hole 13A, as will be described later. At this time, the protrusion located at the other end of the analysis plate can be smoothly moved downward and inserted into the through hole 13A because the inner surface of the first wall portion 101A has the inclined surface 14 above the through hole 13A.

On an inner surface of the first wall portion 101, the inclined surface 14 may, for example, be inclined from the upper side of the through hole 13 (also referred to as the upper edge portion of the through hole) along the upward direction, or be inclined from a position located at a distance from the upper side of the through hole 13 toward the upward direction. In the latter case, the first wall portion 101A having the through hole 13A has, on the inner surface thereof, a first surface 14 and a second surface 15 in that order from the upper end side of the first wall portion 101A toward the through hole 13A, and the first surface 14 is the inclined surface 14. Also, for example, the second surface 15 is located on the through hole 13A side relative to the inclined surface 14, and constitutes a surface where the interval between the inner surfaces of the pair of first wall portions 101 is constant, or a surface where the interval between the inner surfaces of the pair of first wall portions 101 gradually decreases at a degree smaller than the degree at which the interval between the inner surfaces of the pair of first wall portions 101 gradually decreases on the inclined surface 14. For example, as shown in FIG. 3, the first wall portion 101A may have, on the inner surface thereof, above the through hole 13A and on the through hole 13A side relative to the inclined surface 14, a vertical surface (second surface) 15 where the interval between the inner surfaces of the pair of first wall portions 101 is constant, and may have the inclined surface 14 above the vertical surface 15. Although the second surface 15 is a vertical surface in FIG. 3, the present invention is not limited thereto.

For example, the first wall portion 101 may also have, on an inner surface thereof, a base portion 17 on which the analysis plate is to be placed. For example, the base portion 17 is a protrusion protruding in the first opposing direction X below the through holes 13 on the inner surfaces of the pair of first wall portions 101. For example, the base portion 17 may be formed as a protrusion extending continuously on the inner surface of the frame portion 10 as shown in FIG. 1, or separate protrusions may be formed for each of the plurality of areas 12.

The holder 1 includes a coupling portion 11. The coupling portion 11 is disposed below the pair of through holes 13 so as to couple the pair of first wall portions 101A and 101B. As a result of coupling the first wall portions 101A and 101B using the coupling portion 11, it is possible, for example, to suppress deformation of the frame portion 10. Also, through such suppression of deformation, it is also possible, for example, to keep an analysis plate that has been mounted from coming loose. The coupling portion 11 can also be called a reinforcement portion, for example.

As described previously, the number, the size, the shape, and the like of the coupling portion 11 are not particularly limited, as long as the coupling portion 11 is disposed below the through hole 13.

The number of coupling portions 11 for each holder 1 may be, for example, one, or two or more. When the holder 1 includes a plurality of coupling portions 11, a configuration is conceivable in which each of the coupling portions 11 is disposed at a boundary between the plurality of areas 12, for example. FIGS. 1 and 2 show an example of this configuration, in which plate-shaped coupling portions 11 are disposed at five positions respectively forming the boundaries between six areas 12. Examples of the shape of the coupling portion 11 other than a plate shape include a bar shape.

In the holder 1 shown in FIG. 1, the frame portion 10 has a frame shape, as described previously. Therefore, the coupling portion 11 may be formed, for example, as a bottom portion of the frame portion 10. That is, the frame portion 10 and the coupling portion 11 may form a bottomed frame (a tray-shaped frame portion). Also, the bottom portion formed by the coupling portion 11, for example, may be disposed over a portion of or the entirety of the region surrounded by the frame portion 10.

Figure 4:
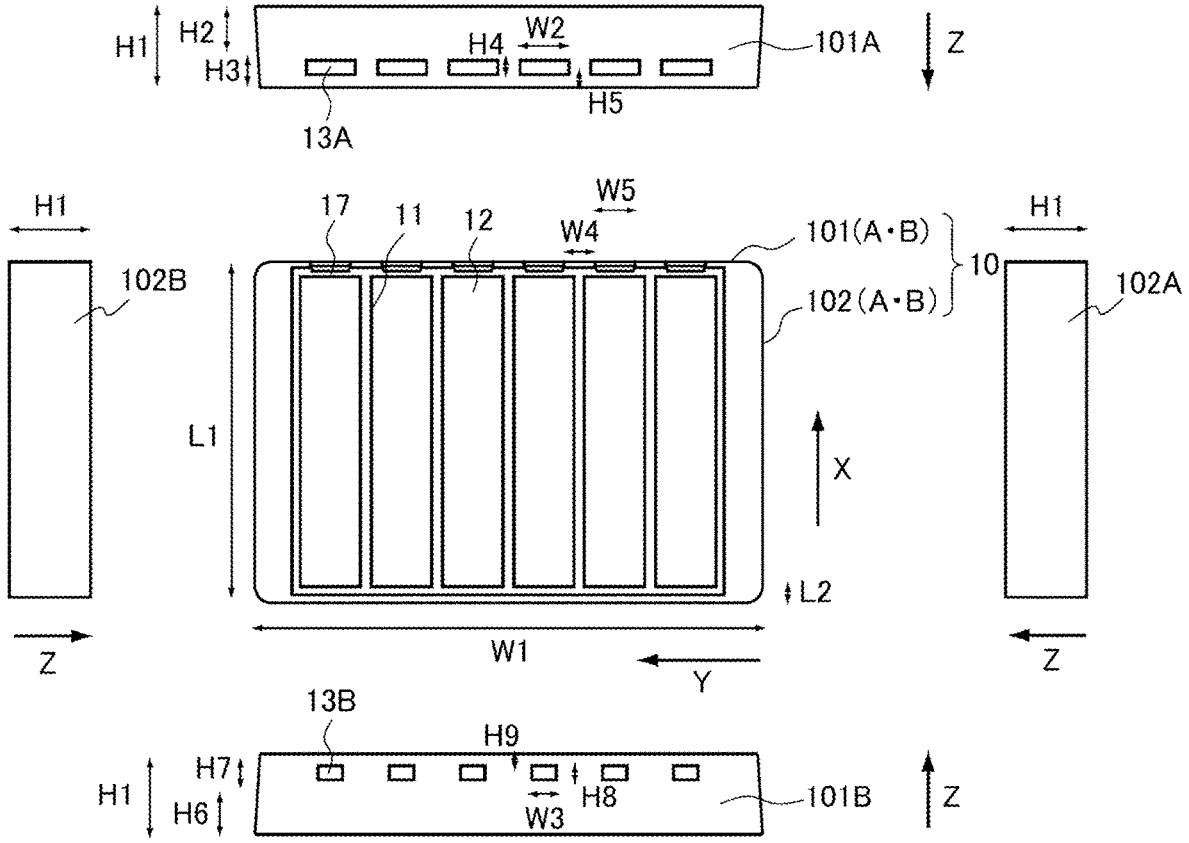
FIG. 4 shows plan views, similar to those shown in FIG. 2, of the holder according to the present invention.
Figure 5:
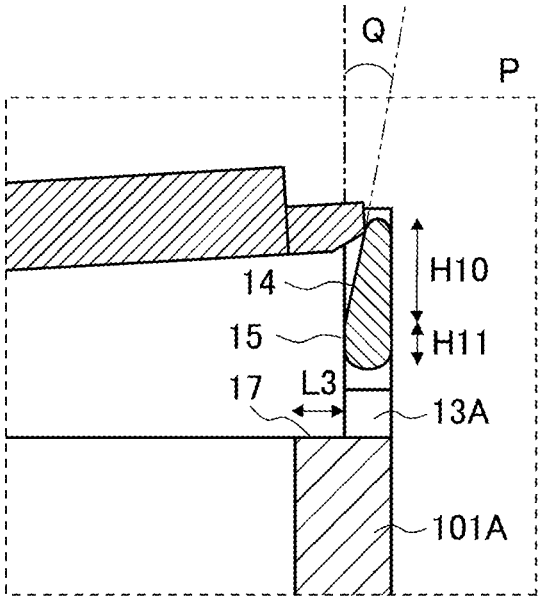
FIG. 5 is a cross-sectional view showing the region indicated by the dotted line P in the holder shown in FIG. 3.

The sizes of the portions of the holder 1 are not particularly limited, and examples of the sizes include the following. FIG. 4 shows the same diagrams as those shown in FIG. 2, and the length of each portion is denoted by a reference numeral. In addition, FIG. 5 shows the region indicated by the dotted line P in FIG. 3 in a partial cross-sectional view.

Frame Portion 10

Length L1 in the first opposing direction X: 20 to 100 mm (85.5 mm)

Length W1 in the second opposing direction y: 20 to 150 mm (127.8 mm)

Length H1 in the height direction Z: 10 to 40 mm (20.6 mm)

First Wall Portion 101A

Width W2 of the through hole 13A: 1 to 20 mm (10.6 mm)

Height H4 of the through hole 13A: 1 to 20 mm (2.5 mm)

Length H5 from the upper side of the first wall portion 101A to the upper side of the through hole 13A (length of an upper region of the through hole 13A): 1 to 10 mm (3.7 mm)

Length H2 from the lower side of the first wall portion 101A to the lower side of the through hole 13A: 5 to 30 mm (14.4 mm)

Length H3 from the upper side of the first wall portion 101A to the lower side of the through hole 13A: 5 to 30 mm (6.2 mm)

Length H10 of the inclined surface 14: 0 to 2 mm (1.0 mm)

Length H11 of the vertical surface 15: 0 to 5 mm (2.8 mm)

Inclination angle Q of the inclined surface 14: 5 to 30° (10°)

Length L3 of the base portion 17: 0 to 5 mm (1.5 mm)

First Wall Portion 101B

Width W3 of the through hole 13B: 5 to 20 mm (7.5 mm)

Height H8 of the through hole 13B: 0.5 to 5 mm (1.45 mm)

Length H9 from the upper side of the first wall portion 101B to the upper side of the through hole 13B: 0.5 to 10 mm (3.66 mm)

Length H6 from the lower side of the first wall portion 101B to the lower side of the through hole 13B: 5 to 30 mm (14.3 mm)

Length H7 from the upper side of the first wall portion 101B to the lower side of the through hole 13B: 5 to 30 mm (6.3 mm)

Length L2 from the upper side of the first wall portion 101B to the boundary between the areas 12: 1 to 5 mm (3.1 mm)

Width W4 of the coupling portion 11: 1 to 5 mm (1.56 mm)

Width W5 of the area 12: 4.5 to 150 mm (18 mm)

The ratios between the lengths of the portions are not limited, and examples of the ratios include the following.

As for the ratio between H9 (the length from the upper side of the first wall portion 101B to the upper side of the through hole 13B) and W3 (the width of the through hole 13B in the first wall portion 101B), assuming H9 as 1, W3 is at least double H9, for example. As for the ratio between H7 (the length from the upper side of the first wall portion 101B to the lower side of the through hole 13B) and H6 (the length from the lower side of the first wall portion 101B to the lower side of the through hole 13B), assuming H7 as 1, H6 is at least double H7, for example.

As described previously, when placing an analysis plate in the holder 1, for example, after one protrusion of the analysis plate has been inserted into one through hole 13B, the other protrusion of the analysis plate is inserted into the other through hole 13A. Accordingly, in consideration of handleability, strength, and the like, the through hole 13B, into which the one protrusion is inserted first, and the through hole 13A, into which the other protrusion is inserted later, may be set to have sizes different from each other.

The holder 1 may be made of resin, for example, and can be produced through die molding, injection molding, or the like. The type of the resin is not particularly limited, and examples thereof include polyethylene, polystyrene, polycarbonate, acrylic, and a cyclic olefin polymer.

Next, the analysis plate will be described. The analysis plate that is to be placed in the placement holder according to the present invention is not particularly limited, as long the analysis plate includes, respectively at opposite ends in a longitudinal direction thereof, protrusions protruding in the longitudinal direction, as described previously. It can also be said that the analysis plate is a chip, a cell, or the like, for example.

Figure 6:
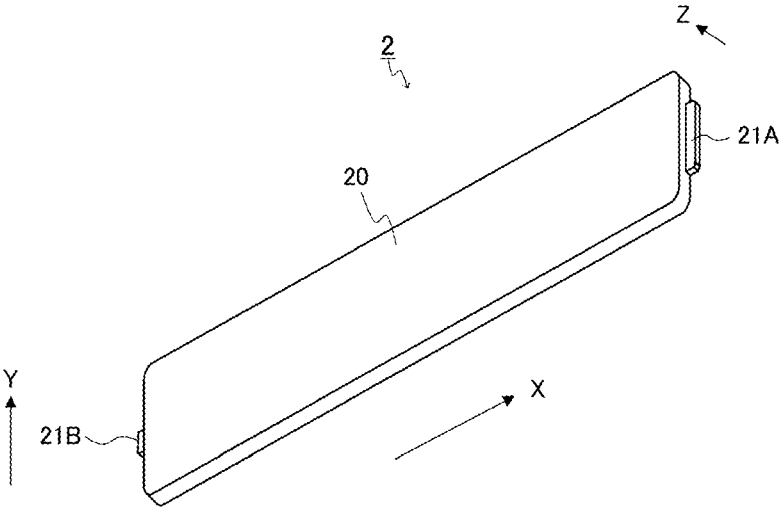
FIG. 6 is a perspective view showing an example of an analysis plate.
Figure 7:
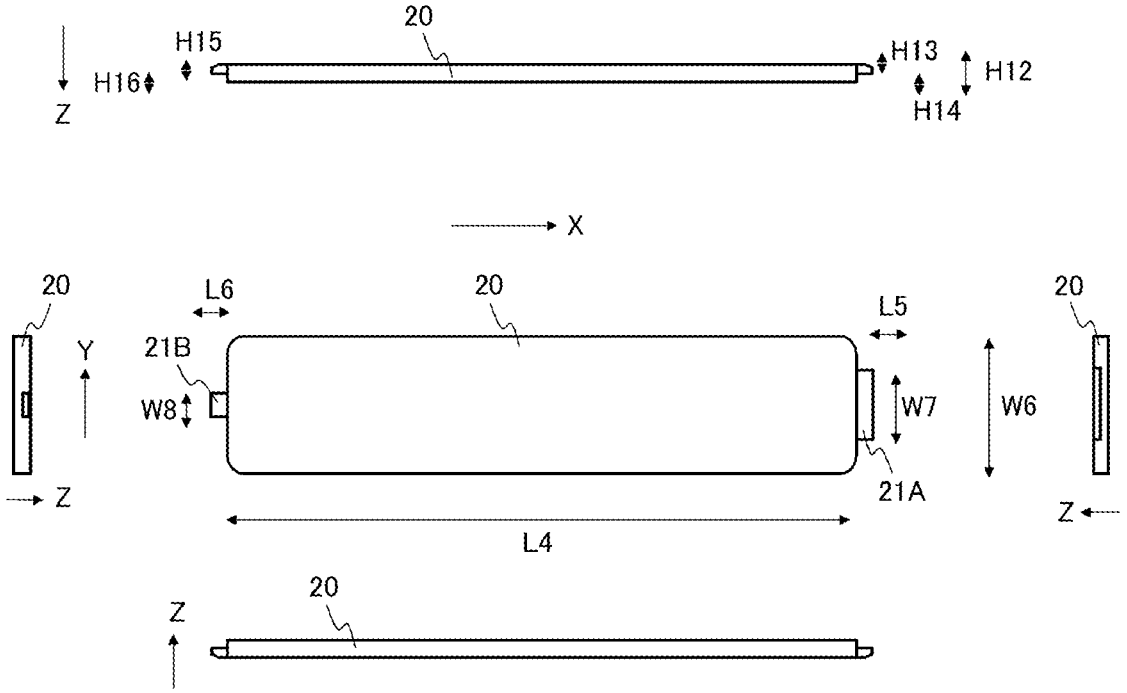
FIG. 7 shows plan views of the analysis plate, with the central diagram showing a plan view as viewed from above, the upper and lower diagrams respectively showing plan views as viewed from the outside in the arrow X direction, and the left and right diagrams respectively showing plan views as viewed from the outside in the arrow Y direction.

An example of the analysis plate is shown in FIGS. 6 and 7. In FIGS. 6 and 7, the arrows X, Y, and Z are shown as directions corresponding to the holder 1 of the present embodiment. In FIG. 6, the X direction is the longitudinal direction of the analysis plate 2, the Y direction is the lateral direction of the analysis plate 2, perpendicular to the longitudinal direction in a plane direction, and the Z direction is the thickness direction of the analysis plate 2, perpendicular to the longitudinal direction and the lateral direction.

FIG. 6 is a perspective view of the analysis plate 2. FIG. 7 shows plan views of the analysis plate 2, with the central diagram showing a plan view as viewed from above, the upper and lower diagrams respectively showing plan views as viewed from the outside in the arrow X direction, and the left and right diagrams respectively showing plan views as viewed from the outside in the arrow Y direction.

The analysis plate 2 includes a body 20 and a pair of protrusions 21 (21A, 21B). The pair of protrusions 21 are respectively disposed at opposite ends in a longitudinal direction of the body 20, and serve as insertion portions to be inserted into the through holes 13 of the holder 1 of the present embodiment. In FIG. 6, of the pair of protrusions 21, one protrusion 21A is an insertion portion for the through hole 13A of the holder 1, and the other protrusion 21B is an insertion portion for the through hole 13B of the holder 1.

The shape of the pair of protrusions 21 of the analysis plate 2 is not particularly limited, and may be set to any shape. In FIGS. 6 and 7, each of the pair of protrusions 21 has a prismatic shape extending in the longitudinal direction (the arrow X direction). The protrusions 21A and 21B may have the same shape or shapes different from each other. The positions of the protrusions 21 on both end faces of the body 20 may be located toward the upper surface of the body 20, may be located toward the lower surface of the body 20, or may be located near the center of the body 20, for example.

For example, the analysis plate 2 has an analysis region (not shown) in the body 20. The number of analysis regions in the body 20 is not particularly limited, and may be, for example, one, or two or more. When a plurality of analysis regions are provided, for example, the plurality of analysis regions may be provided along the arrow X direction, may be provided along the arrow Y direction, or may be provided along both the arrow X direction and the arrow Y direction.

The configuration of the analysis region in the body 20 is not particularly limited, and may be a well configuration, a tube configuration, or a flow path configuration, for example. Although the specific configuration of the analysis region in the body 20 has been omitted in FIGS. 6 and 7, the body 20 may have, for example, a configuration used in PCR and the like, in which a plurality of tubes are successively formed.

The type of the analysis plate 2 is not particularly limited, and any plates used in various types of analysis such as PCR and ELISA may be used, for example.

The analysis plate 2 is made of resin, for example, and can be produced through die molding, injection molding, or the like. The type of the resin is not particularly limited, and examples thereof include polyolefins such as a cyclic olefin polymer, polystyrene, polyethylene, and polypropylene; acrylic, and polycarbonate. The material of the analysis plate 2 may be determined as appropriate according to, for example, the application or the like of the analysis.

The sizes of the portions of the analysis plate 2 are not particularly limited, and examples of the sizes include the following.

Body 20

- Length L4 in the arrow X direction: 20 to 100 mm (80.7 mm)
- Length W6 in the arrow Y direction: 4.5 to 150 mm (17.3 mm)
- Length H12 in the height direction Z: 1 to 30 mm (2 mm)

Protrusion 21A corresponding to Through Hole 13A

- Length L5 in the arrow X direction: 1 to 5 mm (1.9 mm)
- Length W7 in the arrow Y direction: 1 to 100 mm (8.9 mm)
- Length H13 in the height direction Z: 0.5 to 5 mm (1 mm)
- Length H14 from the upper surface of the body 20 to the upper surface of the protrusion 21A: 0.5 to 5 mm (1 mm)

Protrusion 21B corresponding to Through hole 13B

- Length L6 in the arrow X direction: 1 to 5 mm (1.9 mm)
- Length W8 in the arrow Y direction: 1 to 100 mm (2.9 mm)
- Length H15 in the height direction Z: 0.5 to 5 mm (1 mm)
- Length H16 from the upper surface of the body 20 to the upper surface of the protrusion 21B: 0.5 to 5 mm (1 mm)

Next, a method for placing the analysis plate in the holder 1 of the present embodiment will be described with reference to the drawings. Although the analysis plate shown in FIG. 6 is taken as an example of the analysis plate 2, the present invention is by no means limited thereto.

Figure 8:
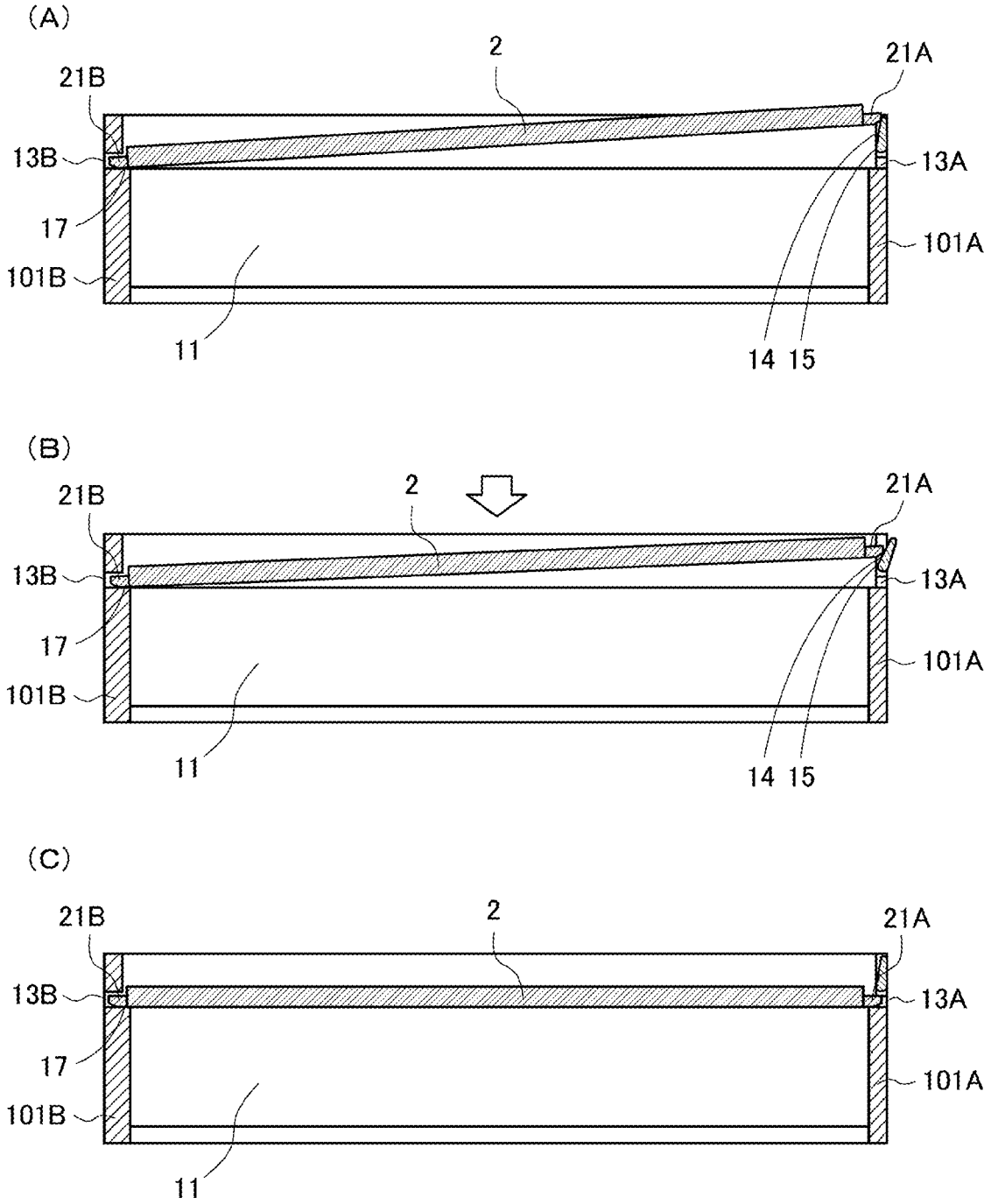
FIG. 8 is a schematic diagram showing processes for placing the analysis plate in the holder according to the present invention.

FIG. 8 shows a schematic diagram showing a state in which the analysis plate 2 is being placed in the holder 1. FIG. 8 corresponds to the cross-sectional view of FIG. 3, with (A) showing a cross-sectional view at a beginning stage of placement of the analysis plate 2 into the holder 1, (B) showing a cross-sectional view at an intermediate stage of the placement, and (C) showing a cross-sectional view at a completion stage of the placement.

As shown in (A) of FIG. 8, the protrusion 21B of the analysis plate 2 is inserted into the through hole 13B of the holder 1. In this state, the other protrusion 21A of the analysis plate 2 is in contact with the inclined surface 14 located above the other through hole 13A of the holder 1, and has not reached the through hole 13A.

Next, as shown in (B) of FIG. 8, the analysis plate 2 is pressed downward (in the direction indicated by the arrow) such that the other protrusion 21A side of the analysis plate 2 gradually approaches the through hole 13A of the holder 1.

The first wall portion 101A of the holder 1 has the through hole 13A. Accordingly, the upper region of the through hole 13A in the first wall portion 101A has a configuration in which deflection is more likely to occur in the first opposing direction X due to the presence of the through hole 13A, as compared with the remaining region. That is, it can be said that the upper region of the through hole 13A in the first wall portion 101A has, for example, a leaf spring-like configuration due to the presence of the through hole 13A. The upper region of the through hole 13A is, for example, the region indicated by H5 in FIG. 4, or the region indicated by H10 and H11 in FIG. 5. Accordingly, when the analysis plate 2 is pressed downward, a force is applied to the analysis plate 2 as a result of being in contact with the holder 1, but the force applied to the analysis plate 2 can be reduced by the upper region having the leaf spring-like configuration. Consequently, deformation or the like caused by the force applied to the analysis plate 2 can be suppressed.

Additionally, the first wall portion 101A of the holder 1 further includes the inclined surface 14 above the through hole 13A. Accordingly, even when a downward pressing force is applied to the analysis plate 2, the protrusion 21A of the analysis plate 2 can be smoothly moved downward along the inclined surface 14 because the protrusion 21A is in contact with the inclined surface 14.

Figure 9:
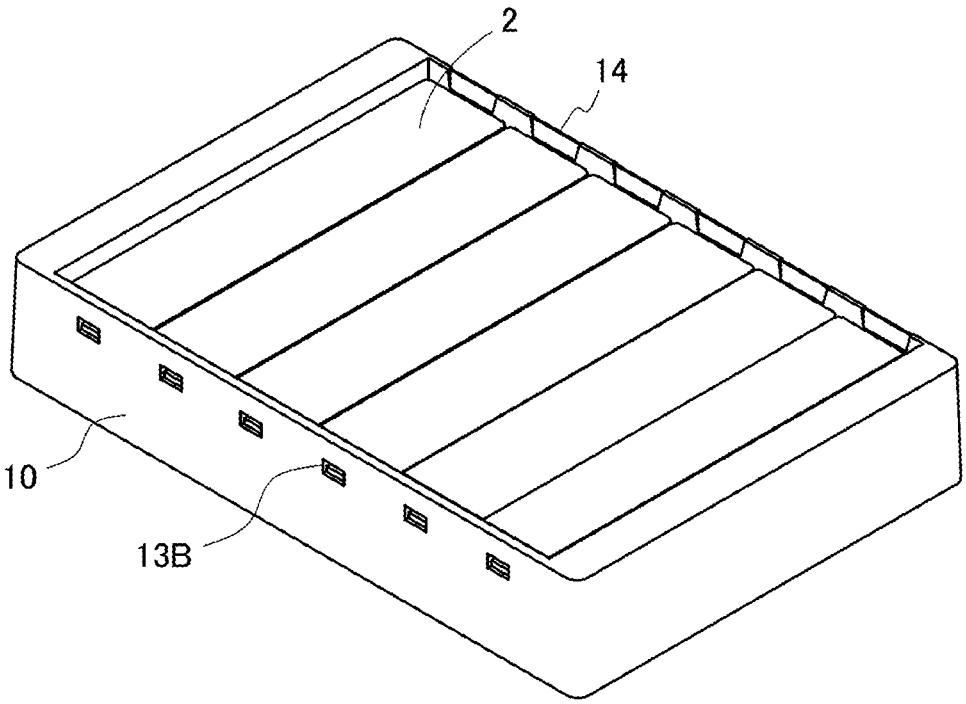
FIG. 9 is a perspective view showing a state in which the analysis plate has been placed in the holder according to the present invention.

Then, as shown in (C) of FIG. 8, the protrusion 21A of the analysis plate 2 reaches the through hole 13A in the holder 1, and is inserted thereinto. Thus, the analysis plate 2 is placed in the holder 1. Since the holder 1 has six areas 12, for example, six analysis plates 2 similarly can be respectively placed in the areas 12 in the holder 1, as shown in the perspective view of FIG. 9.

Note that the analysis plate 2 that has been placed in the holder 1 is less likely to come loose from the holder 1 due to the presence of the through hole 13A in the first wall portion 101A of the holder 1 and the upper region having a leaf spring-like configuration. That is, as previously described, the upper region of the through hole 13A is deflected in the opposing direction X of the first wall portions 101, or in other words, the longitudinal direction of the analysis plate 2. However, since the direction in which the analysis plate 2 is removed from the holder 1 is the height direction Z, the upper region of the through hole 13A will not deflect even if the analysis plate 2 is pulled up from the holder 1. Accordingly, the protrusion 21A of the analysis plate 2 cannot be easily removed from the through hole 13A.

As such, the holder 1 has the through hole 13A, and thus the upper region of the through hole 13A has the leaf spring-like configuration. Moreover, due to having the inclined surface 14, the holder 1 allows easy placement of the analysis plate 2, and makes the analysis plate 2 less likely to come loose.

Analysis Kit

As described above, an analysis kit according to the present invention includes: the placement holder according to the present invention; and an analysis plate, wherein the analysis plate includes, respectively at opposite ends in a longitudinal direction thereof, protrusions protruding in the longitudinal direction.

The analysis kit according to the present invention is characterized by including the placement holder according to the present invention, and there is no limitation with respect to the rest of the configuration and the like. In the analysis kit according to the present invention, the analysis plate may include the pair of protrusions. The above description of the placement holder according to the present invention can be applied to the analysis kit according to the present invention.

The analysis kit according to the present invention may be in a state in which the analysis plate is placed in the placement holder, or may be in a state in which the analysis plate is not placed in the placement holder. There is no particular limitation with respect to the number of analysis plates for each placement holder in the analysis kit according to the present invention.

Although the present invention has been described above with reference to the embodiments, the present invention is not limited to the above-described embodiments. Various modifications that can be understood by a person skilled in the art may be made to the configuration and the details of the present invention within the scope of the invention.

This application claims priority to Japanese Patent Application No. 2017-238045 filed on Dec. 12, 2017, the disclosure of which is incorporated in its entirety herein by reference.

INDUSTRIAL APPLICABILITY

As described above, the placement holder according to the present invention allows easy placement of an analysis plate, and can prevent the placed analysis plate from coming loose due to vibration or the like. Accordingly, it is possible to provide an analysis kit with excellent handleability during analysis or the like.

REFERENCE SINGS LIST

1 Holder
10 Frame portion
101A, 101B First wall portion
102A, 102B Second wall portion
11 Coupling portion
12 Area
13A, 13B Cavity
14 First surface (inclined surface)
15 Second surface (vertical surface)
17 Base portion
2 Analysis plate
20 Body
21A, 21B Protrusion

The invention claimed is:

1. A placement holder for an analysis plate, the placement holder comprising:

a frame that comprises:

first and second walls, each having first and second ends, that are opposed to each other to define opposite first and second sides of the frame, and third and fourth walls that define third and fourth sides of the frame, the first end of the first wall being connected to the first end of the second wall via the third wall, and the second end of the first wall being connected to the second end of the second wall via the fourth wall, to define a space surrounded by the frame that is adapted to accept an analysis plate to be held by the placement holder, each of the first and second walls having a respective one of a pair of cavities that are adapted to accept protrusions at opposite ends of an analysis plate to be held by the placement holder, the cavity of the first wall being a through hole extending through the first wall and having a physically distinct outer circumference, and a surface of the first wall that faces the second wall having an inclined surface formed such that an interval between the first and second walls decreases from an upper end side of the first wall toward the through hole.

2. The placement holder according to claim 1, further comprising additional pairs of the cavities, and each of the first and second walls has a respective one of each of the additional pairs of cavities.

3. The placement holder according to claim 1, wherein the first wall has, on the surface facing the second wall, a first surface and a second surface in that order from the upper end side of the wall toward the through hole, the first surface is the inclined surface, and the second surface is located on a through hole side and closer to the through hole relative to the inclined surface, and constitutes a surface where an interval between the first and second walls is constant, or a surface where an interval between the first and second walls decreases at a degree smaller than a degree at which the interval between the first and second walls decreases along the inclined surface.

4. The placement holder according to claim 1, wherein each of the first and second walls includes a protrusion located below the corresponding cavity, and each of the protrusions of the first and second walls is configured to serve as a base on which the analysis plate is to be placed.

5. The placement holder according to claim 1, wherein the frame is quadrangular in planar view.

6. The placement holder according to claim 1, wherein the placement holder is made of resin.

7. An analysis kit comprising;

the placement holder for an analysis plate according to claim 1; and an analysis plate, wherein the analysis plate includes protrusions respectively located at opposite ends of the analysis plate.

* * * * *